United States Patent [19]

Segebrecht et al.

[11] Patent Number: 4,710,105

[45] Date of Patent: Dec. 1, 1987

[54] LIQUID-RING COMPRESSOR UNIT

[75] Inventors: Udo Segebrecht; Siegfried Auschrat, both of Heiligenstedten, Fed. Rep. of Germany

[73] Assignee: Sihi GmbH & Co. KG, Itzehoe, Fed. Rep. of Germany

[21] Appl. No.: 833,390

[22] PCT Filed: Jun. 10, 1985

[86] PCT No.: PCT/EP85/00286

§ 371 Date: Feb. 13, 1986

§ 102(e) Date: Feb. 13, 1986

[87] PCT Pub. No.: WO86/00117

PCT Pub. Date: Jan. 3, 1986

[30] Foreign Application Priority Data

Jun. 13, 1984 [DE] Fed. Rep. of Germany ..... 3421866

[51] Int. Cl.[4] ..... F04C 19/00

[52] U.S. Cl. ..... 417/68; 55/437; 55/443

[58] Field of Search ..... 417/68, 69; 418/DIG. 1, 418/97, 98, 99, 100; 55/437, 465, 442

[56] References Cited

U.S. PATENT DOCUMENTS

| | | | |
|---|---|---|---|
| 1,530,973 | 3/1925 | Anderson | 418/DIG. 1 |
| 1,626,768 | 5/1927 | Vollmann | 418/DIG. 1 |
| 1,702,939 | 2/1929 | Greenfield | 418/DIG. 1 |
| 2,057,381 | 10/1936 | Kenney et al. . | |
| 2,070,151 | 2/1937 | Westin | 418/DIG. 1 |
| 2,227,441 | 1/1941 | Coleman | 418/DIG. 1 |
| 3,771,898 | 11/1973 | Segebrecht | 417/68 X |
| 3,884,596 | 5/1975 | Hoffmeister | 417/68 |

FOREIGN PATENT DOCUMENTS

| | | | |
|---|---|---|---|
| 459056 | 4/1928 | Fed. Rep. of Germany . | |
| 148097 | 9/1982 | Japan | 418/DIG. 1 |
| 29791 | 2/1984 | Japan | 418/98 |
| 6938 | of 1910 | United Kingdom . | |
| 377476 | 7/1932 | United Kingdom . | |
| 393977 | 6/1933 | United Kingdom . | |
| 858422 | 1/1961 | United Kingdom | 417/68 |

*Primary Examiner*—Leonard E. Smith

*Attorney, Agent, or Firm*—Chilton, Alix & Van Kirk

[57] ABSTRACT

Fluid-ring compressor unit having a horizontal shaft and a compressor housing in which, subsequent to the compressor stage, a pressure chamber is made in connection with a pressure connecting piece. The pressure chamber is divided up by a wall, which projects upward at least up to the level of the pressure opening of the compressor stage, into a first area and a second area which are connected to one another above the wall while forming a route for the delivered medium, the second area of which is connected to the pressure connecting piece. The necessity of a separate fluid separator is avoided according to the invention by the pressure chamber being designed as a fluid separator. For this purpose, the route for the delivered medium, in the upper area of the pressure chamber, is equipped with a plurality of deflection portions and/or baffle surfaces which also block off the pressure connecting piece arranged at the top from the pressure opening. The second area of the pressure chamber is designed as a collecting chamber for the separated fluid and has a fluid overflow at a mean level and an essentially deeper-lying connection of small cross-sesction to the first area, which connection, when the compressor is stopped, enables the level to be balanced.

6 Claims, 1 Drawing Figure

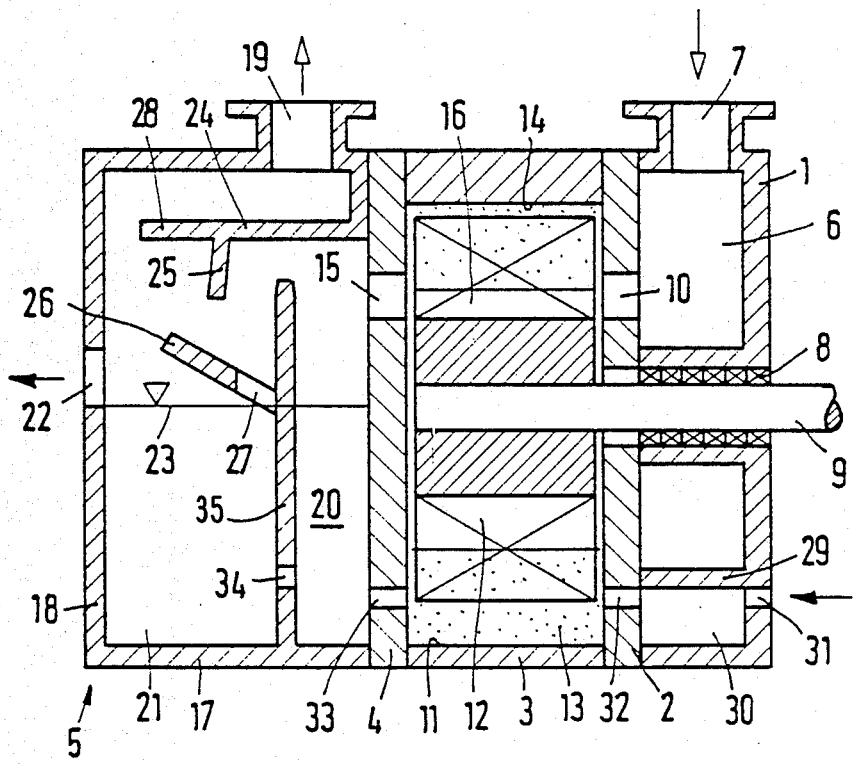
19
7
28
24
16
14
1
6
25
15
10
26
8
22
23
27
9
35
20
29
34
18
31
5
21
17
33
4
11
12
3
13
32
2
30

LIQUID-RING COMPRESSOR UNIT

The invention relates to a liquid-ring compressor unit having a horizontal shaft and a compressor housing in which, subsequent to the, in some cases, last compressor stage, a pressure chamber is made in connection with a pressure connecting piece, which pressure chamber is divided up by a wall, which projects upward into the geodetically upper area of the pressure chamber at least up to the shaft level and at least up to the level of the pressure opening of the compressor stage, into a first area and a second area which are connected to one another above the wall while forming a route for the delivered medium and the second area of which is connected to the pressure connecting piece.

As is known, liquid-ring compressors require an operating liquid which participated in forming the compressor cells, seals gaps inside the delivery chambers and contributes to the dissipation of the heat developing during compression. It is unavoidable that a portion of the operating liquid ingresses into the delivered gas and, together with the latter, emerges through the pressure opening out of the delivery chamber of the compressor stage and is fed further by the delivered gas. In general, therefore, a liquid separator is subsequently connected in which the liquid which is fed along with the gas is separated from the gas flow, so that, at the outlet of the separator, gas emerges which, although saturated with vaporized liquid, is otherwise essentially fluid free. The liquid remaining behind in the separator is then either resupplied to the compressor, the fluid being cooled in the circulation, or discharged via a separate outlet.

Liquid separators are known which are allocated to the compressor as separate components. For example, embodiments are known in which the liquid separator is set up in an open or closed type of construction next to the compressor, which is associated with a considerable space requirement. It is also known to position the liquid separator above the compressor on the upper-lying suction connecting piece; apart from the considerable space requirement and the complicated construction, this has the disadvantage that care has to be taken by means of control devices to ensure that, after the unit is switched off, not too much liquid flows back into the compressor so as to guarantee problem-free restarting.

In another known embodiment, the separator is integrated in the base frame of the unit; but this is complicated and expensive to embody, with the feedback of operating liquid into the compressor after the unit is switched off also being problematic. It is also known to arrange the compressor in a pot-like designed separator vessel, with the separator chamber surrounding the compressor. This is only possible with small compressor constructions. Moreover, this arrangement has design disadvantages, because either suction and pressure connecting pieces have to be arranged on one axial side of the compressor in a housing part or—if one of the connecting pieces is arranged on the separator vessel—the vessel must be appropriately stable and therefore expensively made (DE-C No. 1,293,942).

Finally, it is known (FR-A No. 2,225,637) to arrange a trough beneath the pressure chamber—which contains a partition wall for deflecting the flow of the medium—and inside the pedestal or base plate of the compressor, which trough forms a separator vessel; since this trough lies essentially deeper than the working chamber of the compressor, the feedback of liquid after the compressor is switched off is problematic.

Liquid separators are also known in vane-cell compressors. These liquid separators are used to re-extract the oil used for lubricating the compressor, provided this oil has ingressed into the gas flow. However, there are fundamental differences in the separation of the liquid in liquid-ring compressors on the one hand and vane-cell compressors on the other hand. In liquid-ring compressors, the liquid directly participates in the formation of the compressor cells, with large quantities of the operating liquid being fed out of the working chamber with the gas flow as a result of the large-area phase exchange. On the other hand, the oil quantities which in a vane-cell compressor ingress into the gas flow are comparatively small, so that relatively small liquid separators are adequate. Thus there are proposals for connecting the liquid separator to the compressor in a common housing, although with very complicated and therefore expensive housing forms being reached (GB-A No. 393,977 DE-C No. 459-056, U.S. Pat. No. 2,057,381).

No liquid separator is provided in the type of construction of a liquid-ring compressor (GB-A No. 377,476) portrayed at the beginning of this description. The pressure chamber contains a partition wall projecting upward from below up to the level of the pressure opening of the pump stage, which partition wall subdivides the pressure chamber into two areas. It is used to keep a liquid supply in the first area directly following the pressure opening, which liquid supply prevents the back flow of gas into the beginning of the pressure opening. The second pressure chamber area located behind the wall leads directly to the pressure connecting piece. In this embodiment, the entire liquid quantity contained in the delivered gas flow is fed out of the pressure chamber through the pressure connecting piece, so that it is necesary to subsequently connect a liquid separator. That the pressure chamber cannot be used as a liquid separator can be recognized from the fact that no provisions are taken to dissipate the separated liquid separately from the gas flow. According to another known proposal (DE-B No. 2,036, 295= FR-A No. 2,103,218), the pressure chamber is subdivided by walls into a first and a second area in such a way that, in the first area, a liquid level is constantly maintained well above the pressure opening. The intention of this is to attenuate noise by the direct sound connection between the pressure opening and the pressure connecting piece being prevented by the liquid gas mixture filling the first pressure chamber area. A separation effect cannot be achieved in the known pressure chamber; on the contrary, the entire liquid arriving there with the gas flow must be discharged to a fluid separator which must be provided separately.

The object of the invention is to equip a liquid ring compressor of the type mentioned at the beginning, having less space requirement and lower constructional expense, with a liquid separator.

The object is achieved according to the invention in that the second area of the pressure chamber has a liquid overflow part which is separated from the pressure connecting piece and is located at a mean level, and that a plurality of deflection portions and/or baffle surfaces are formed in the route for the delivered medium arranged in the upper area of the pressure chamber, which deflection portions and/or baffle surfaces block off the pressure connecting piece lying above the fluid overflow from the pressure opening.

These features are already partially known in the state of the art, but there they each serve separate functions, whereas in connection with the invention they interact in a mutually supportive manner. The wall separating the two areas of the pressure chamber is used during compressor operation to maintain a water supply in front of the pressure opening so as to eliminate the backflow of gas. At the same time, however, it has an effect which is not used in the state of the art and promotes the separation of the liquid by the fluid which comes out of the pressure opening and strikes against the wall tending to separate from the gas flow which emerges out of the opening at the same time. A more or less stabilized liquid supply collects in the second area of the pressure chamber, with both the function of the formation of a liquid supply and the discharging of the separated liquid through an overflow being used. The ribs provided in the upper area of the pressure chamber have in known manner a function which promotes separation, with the ribs interacting with the upwardly projecting wall mentioned and with the pressure chamber area collecting the separated liquid and preventing, by blocking off the pressure connecting piece from the pressure opening, a portion of the gas flow from reaching the pressure connecting piece without having to be subjected to an adequate separation effect beforehand.

The overflow of the second pressure chamber area is preferably located at about the level of the shaft; however, it can also be located at another point approximately within the center third of the pressure chamber level.

The features that the pressure chamber is formed subsequent to the compressor stage in the compressor housing is intended to imply that the pressure chamber and the working chamber of the compressor stage essentially extend over the same width and height within the same housing boundaries, with minor deviation of the upper and/or lower boundaries being possible provided this does not put the uniformity of the housing design in question. The uniformity of the housing design is given at least when the walls of the pressure chamber can be considered approximately as a continuation of the walls of the working chamber, especially in the axial direction. Especially advantageous is the continuously cylindrical construction of the housing walls of the pump stage and the pressure chamber, with the pressure connecting piece being expediently connected to the pressure chamber at the top. The housing parts enclosing the pressure chamber and the pump stage need not be made in one piece.

The route of the medium between the two pressure chamber areas is expediently designed as a bent channel. In this connection, a rough separation of liquid and gas is achieved within the bent channel, which separation is improved and completed by the guide and baffle ribs attached in and after the bent channel.

At least a portion of the operating liquid contained in the pressure chamber can be fed back from the second area of the pressure chamber through a flow connection, which in principle is known for such purposes, in the circulation into the working chamber of the compressor. A portion of the necessary operating liquid can also be removed from the pressure chamber and a further portion can be constantly freshly supplied from a separate source, with it being possible to cool the latter portion such that the temperature of the operating liquid is kept at the desired level. A cooling device can also be arranged in a way known per se in the liquid separator of the pressure chamber.

The flow connection can be formed by a separate line which leads from the second area of the pressure chamber into a part of the working chamber at a lower pressure. It can also be formed by an opening in the wall dividing up the pressure chamber, through which wall liquid flows back into the first area of the pressure chamber and from here through the pressure slot or separate flow connections into the working chamber of the compressor. Independently of any flow connection for feeding back operating liquid into the working chamber of the compressor, at least one level-balancing opening of small cross-section can be provided in the wall, which level-balancing opening, in the event of the machine being switched off, enables a liquid surplus, which would cause difficulties in the working chamber during restarting, to discharge via the first area of the pressure chamber. Conversely, liquid supply collected in the second area of the pressure chamber and required for restarting the pump can also be fed back through this opening into the working chamber.

To maintain the minimum liquid level during the entire operation when operating with cooling in the pressure chamber, a level controller can be provided in the liquid separator of the pressure chamber.

By means of the invention, the otherwise additionally necessary liquid separator can be dispensed with for only a slight increase in the outer dimensions of the compressor and an adequate separation of gas and liquid is nevertheless achieved.

The invention is described in greater detail below with reference to the drawing which consists of one FIGURE showing a schematic longitudinal section through a compressor.

The housing of the compressor is formed by the suction cover 1, the suction-side control disk 2, the housing 3 of the compressor stage, the pressure-side control disk 4 and the pressure chamber housing 5. These housing parts have an approximately corresponding, circular cross-sectional form in the transverse section to the drawing plane.

The suction cover 1 contains the suction chamber 6, to which the gas to be delivered is supplied via the suction connecting piece 7 arranged at the top. It also contains a hub with a shaft bore which encloses a seal 8 for sealing the rotor shaft 9.

The suction cover 1 is tightly connected to the suction-side control disk 2 which contains the suction opening 10 at a suitable, known location which does not need to correspond with the location shown.

The housing 3 of the compressor stage is tightly connected to the suction-side control disk 2. It forms an annular housing wall, the inner surface 11 of which lies excentrically to the shaft 9 and, together with the vane rotor 12 sitting on the shaft, encloses the working chamber 13 in which the liquid ring, shown dotted, rotates radially on the outside and closes off the vane cells between the vanes on the outside. In the case shown, the apex of the working chamber 13, that is, the location of minimum radial distance, between the inner surface 14 of the housing part 3 and the rotor 12, is geodetically arranged at the top.

The pressure-side control disk 4 tightly adjoins the compressor stage, which control disk 4 contains the pressure opening 15 at a known, suitable location. It always lies near to the inner boundary 16 of the vane cells in the rotary direction just before the apex of the working chamber. In the case shown, it therefore has to be imagined as being above the level of the shaft.

Tightly adjoining the control disk 4 is the pressure chamber housing 5 which is formed by, for example, a cylindrical wall part 17 and a flat wall part 18 at the end face and to which is connected the pressure connecting piece 19 at the top. Inside the pressure chamber housing 5 a wall 35 projects upward in the vertical direction from below up to the level of the pressure opening 15, which wall 35 separates the first pressure chamber area 20 from the second pressure chamber area 21, the axial size of the first area 20 being about $\frac{1}{3}$ to $\frac{1}{2}$ the axial width of the working chamber 13, while the axial size of the second area 21 is about two to three times as great as that of the first area. The second pressure chamber area 21 has a discharge or overflow opening 22, the lower edge of which determines the liquid level 23 in the second pressure chamber area 21, the wall 35 rising considerably above the level 23.

A roughly horizontal rib 24 lies above the first pressure chamber area 20 and the wall 19 and thus forces the flow of medium emerging from the pressure opening 15 and striking against the wall 19 to deflect further in the horizontal direction. In the context of the present description, the medium should be understood as the fluid mixture of gas and entrained working liquid resulting from the operation of the working chamber. On the other side of the wall 19 follows a rib 25 which projects down from the rib 14 (sic) and deflects the flow of medium downward. Here it strikes a rib 26 which diverts the flow of medium obliquely upward and blocks off the liquid collected in the second pressure chamber area 21 so as consequently to prevent the fluid already separated from the gas flow being drawn along again. The rib 26 contains one or more openings 27 for the passage downward of the separated liquid. A portion of the flow of medium diverted upward by the rib 26 hits the horizontal rib 28, which represents a continuation of the rib 24, in order subsequently to be horizontally deflected by the upper part of the housing wall 17 towards the pressure connecting piece 19. The ribs 24 and 28 form an effective blocking off of the pressure connecting piece 19 from the pressure opening 15 and those areas of the flow of medium in which even greater porportions of drawn-along liquid can be expected.

The shaft 9 can be mounted inside the housing at a location which is not shown, for example in the control disks 2 and 4.

In the geodetically deep-lying area, the suction cover 1 contains a chamber 30 which is partitioned off by a wall 29 and is connected to a fresh liquid source (not shown) via a bore 31. The chamber 30 is connected to the working chamber 13 by a bore 32. Fresh liquid can therefore be supplied in the desired quantity to the working chamber of the pump stage via the route 31, 30, 32.

At a geodetically deep-lying location, the pressure-side control disk 4 contains a small bore 33 through which operating liquid can flow back from the first area 20 of the pressure chamber into the working chamber 13 during operation and which also enables the level to be balanced when the compressor is stopped. Likewise, at a geodetically deep-lying location, the wall 35 contains a small bore 34 which serves to balance the level when the compressor is stopped.

During operation, the compressor sucks gas from the suction connecting piece 7 via the suction chamber 6 and the suction opening 10, which gas is compressed in the working chamber 13 in order to be ejected through the pressure opening 15 into the first area 20 of the pressure chamber. In this location, liquid collects which is held back in front of the pressure opening by the wall 35 in order to form a liquid barrier against the backflow of gas into the pressure opening. The gas/liquid mixture flowing out strikes against the upper part of the wall 35, by which means separation is promoted, then flows through the bent channel which is formed by the wall 35, the rib 24 and the rib 25 and in which a rough separation takes place, in order to reach the pressure connecting piece 19 after further separation in the area of the ribs 26 and 28, with the ribs and the pressure chamber walls forming in this way deflection portions and baffle surfaces at which the liquid separates.

The liquid surplus arriving in the second area 21 of the pressure chamber flows off through the overflow 22. A portion of the liquid located in the pressure chamber flows back through the opening 33 into the working chamber 13, whereas another portion of the operating liquid loss is balanced by fresh liquid supply.

When the compressor is switched off, the level can be balanced through the openings 33 and 34, which on the one hand ensures that the minimum liquid supply necessary for restarting is available in the working chamber 13 of the pump and on the other hand ensures that any liquid surplus runs off through the overflow 22.

The invention is not restricted to the arrangement shown; on the contrary, modifications can be made according to the knowledge of the specialist. For example, the compressor can be multistage design, with the last compressor stage in each case taking the place of the compressor stage shown in the drawing. Furthermore, the invention can also be used in compressor constructions in which suction and pressure connecting pieces are arranged on the same axial side of the pumping stage, by forming both suction and pressure connecting chambers separate from one another in the same housing part.

We claim:

1. In a liquid ring compressor unit having an elongated horizontal housing including a gas inlet suction connection piece in communication with a suction intake chamber leading to at least one compressor stage, a shaft passing horizontally through the compressor stage, an outlet pressure connection piece in communication with a pressure opening in the last compressor stage, the last compressor stage including a working chamber having a vane rotor mounted on the shaft which cooperates with a working liquid ring to compress the gas and to form a fluid medium containing said gas and entrained working liquid, the fluid medium being discharged through said pressure opening into said pressure connection piece, wherein the improvement comprises:

the housing including a pressure chamber located longitudinally adjacent the last compressor stage, the pressure chamber having substantially the same height and width dimensions as the compressor stage;

the pressure opening being located in a geodetically upper portion of the compressor stage and extending horizontally into communication with the pressure chamber;

the pressure chamber including a vertical wall which projects upwardly at least to a position directly opposed to the pressure opening, the wall defining a first region between the wall and the compressor stage and a second region between the wall and one longitudinal end of the housing, the first and second regions being in fluid communication above the wall;

said pressure connection piece being in communication with a geodetically upper portion of said pressure chamber through a penetration in the housing;

a liquid overflow discharge port separate from the pressure connection piece, located in the second region and penetrating the housing;

baffle means positioned between the top of the wall and the pressure connection piece, for defining a baffled flow path within the second region between the wall and the pressure connection piece;

whereby the fluid medium emerging from the pressure opening strikes against the wall such that a large part of the liquid is separated in the first region and the medium then enters the baffled flow path where at least some of the liquid remaining in the medium is deposited on the baffle means before the medium is discharged through the pressure connection piece.

2. The liquid-ring compressor unit of claim 1, wherein the liquid overflow port is located at the level of the shaft.

3. The liquid-ring compressor unit of claim 1, wherein the path for the delivered medium from the first to the second regions comprises a bent channel subsequent to the pressure opening.

4. The liquid ring compressor unit of claim 1, wherein the second region contains a substantially stabilized liquid supply for return to the working chamber.

5. The liquid-ring compressor unit of claim 4, wherein a flow connection leads from the second region of the pressure chamber to the working chamber of the compressor stage.

6. The liquid-ring compressor unit of claim 4, wherein at least one oepning is contained in the wall to balance the liquid level between the first and second regions.

* * * * *